US006036483A

United States Patent [19]

Meyer et al.

[11] Patent Number: 6,036,483

[45] Date of Patent: Mar. 14, 2000

[54] METHOD OF CONTROLLING THE CONVEYING SPEED OF A GRATE COOLER

[75] Inventors: Hartmut Meyer, Thomasburg; Jürgen Cordes, Neu Neetze, both of Germany

[73] Assignee: BMH Claudius Peters Aktiengesellschaft, Buxtehude, Germany

[21] Appl. No.: 09/271,681

[22] Filed: Mar. 18, 1999

[30] Foreign Application Priority Data

Mar. 18, 1998 [EP] European Pat. Off. ..... 98 104 947 1

[51] Int. Cl.[7] ..... F27B 9/40

[52] U.S. Cl. ..... 432/45; 432/137; 198/573

[58] Field of Search ..... 432/77, 137, 45; 110/281; 198/502.2, 572, 573, 301, 334, 341.09, 401

[56] References Cited

U.S. PATENT DOCUMENTS

| | | | |
|---|---|---|---|
| 2,031,047 | 2/1936 | Lee | 263/32 |
| 2,055,941 | 9/1936 | Newhouse | 263/32 |
| 2,084,976 | 6/1937 | Puerner | 432/45 |
| 3,064,357 | 11/1962 | Butters | 34/52 |
| 3,208,741 | 11/1965 | Wilhelm | 263/32 |
| 3,236,358 | 2/1966 | Gieskieng | 198/37 |
| 3,929,219 | 12/1975 | Malcolm | 198/571 |
| 4,170,183 | 10/1979 | Cross | 110/281 |
| 5,129,820 | 7/1992 | Kupper et al. | 432/77 |

FOREIGN PATENT DOCUMENTS 2327903 1/1974 Germany .

OTHER PUBLICATIONS

Patent Abstracts of Japan; Publication No. 053198770; Publication Date Mar. 12, 1993.

*Primary Examiner*—Denise L. Ferensic
*Assistant Examiner*—Gregory A. Wilson
*Attorney, Agent, or Firm*—Alix, Yale & Ristas, LLP

[57] ABSTRACT

Method of controlling the conveying speed of a grate cooler as a function of the state of the bed of material to be cooled in the initial region of the cooler while taking into account the flow resistance of said bed of material. According to the invention, the conveying speed, in addition to being controlled as a function of the flow resistance, is also controlled as a function of the height of the bed of material to be cooled.

4 Claims, No Drawings

METHOD OF CONTROLLING THE CONVEYING SPEED OF A GRATE COOLER

BACKGROUND OF THE INVENTION

The effectiveness of grate coolers for burned material, for example for cooling cement clinker, depends on the evenness with which the grate is covered by the material to be cooled. If the thickness of the bed of material is uneven, the cooling air driven from below through the grate will mainly flow through those regions of the bed of material which have a smaller thickness and consequently a lower flow resistance. The regions in which the thickness of the bed of material to be cooled is greater will possibly be cooled inadequately or a greater cooling input has to be applied in order to achieve adequate cooling even in those regions of the bed of material where the throughflow is less pronounced. Since the burned material to be cooled is, as a rule, not discharged completely uniformly from the upstream kiln into the initial region of the cooler, a uneven grate covering has to be expected.

To avoid this disadvantage, it is known to measure the height of the layer of material to be cooled in the initial section of the grate and to control the conveying speed of the grate in such a way that as even a layer height as possible is achieved. The layer height is determined, for example, by means of gamma-radiation meters (U.S. Pat. No. 3,064,357; U.S. Pat. No. 3,236,358; "ZEMENT-KALK-GIPS" 1967, 152–156) or via the weight of the grate covering (DE-A-195 41 455) or via special sensors (U.S. Pat. No. 2,055,941). Furthermore, it has been proposed to control the conveying speed of the cooling grate as a function of the flow resistance in the initial region of the same (U.S. Pat. No. 2,084,976; Patent Abstracts of Japan 05319877; "ZEMENT-KALK-GIPS" 1974, 559–564). This also applies to another known case (DE-A-23 27 903) in which the flow resistance calculated from the pressure below the grate is included in the control of the grate speed. In addition, the clinker throughput and the quantity of the raw meal are measured and included in the control of the feed speed in order to adapt the cooling-air quantity available as secondary air to the fluctuating process conditions of the rotary tubular kiln and to permit optimum heat recovery. The height of the bed of material to be cooled is not measured; it also cannot be derived from the quantity of raw meal or from the clinker throughput on account of the non-uniformity with which the cooling gas passes out of the kiln into the cooler. Finally, it is known to control the conveying speed as a function of the temperature of the cooler exhaust air (U.S. Pat. No. 2,031,047) or of the grate-plate temperature (U.S. Pat. No. 3,208,741) regardless of the actual height of the layer of material to be cooled. In periods of low accumulation of the material to be cooled, which at constant conveying speed would result in regions where the grate covering is slight, the conveying speed of the grate is reduced; the procedure is reversed in periods of increased accumulation of the material to be cooled. However, it has been found that the improvement which can be achieved in this way is very limited. This is due to the fact that the flow resistance depends not only on the thickness of the bed of material to be cooled but also on its grain size distribution, which likewise may very with fluctuations in the kiln operation. The coarse the clinker grain is, the lower the flow resistance is at the same height of the bed of material to be cooled. If, for example, coarse kiln residue fragments accumulate, the measured flow resistance is comparatively small, which, during control as a function of throughflow, leads to a reduction in the conveying speed of the cooling grate with the risk of overfilling of the grate.

SUMMARY OF THE INVENTION

The invention improves the cooler operation owing to the fact that the conveying speed is controlled as a function of both the height of the bed of material to be cooled and the flow resistance.

The weak points which are unavoidable when only the flow resistance is taken into account are reduced by the effect of the height of the bed of material to be cooled. Thus, in the example just mentioned of the accumulation of coarse kiln residue fragments, the measurement of a correspondingly large height of the bed of material to be cooled will tend to cause the conveying speed to accelerate, and this will at least compensate for the countereffect of the lower flow resistance. This avoids a situation in which the cooler inlet shaft could become overfilled with coarse kiln residue fragments and the drive of the cooler grate could be overloaded, which would result in a shutdown of the kiln.

A further advantage of the invention consists in the fact that, if the clinker bed height falls below a minimum value, the conveying motion of the grate can be stopped. As a result, in the event of interruptions in operation, the grate is also covered with material in the initial region. This prevents hot material from falling onto the unprotected grate when restarting, and the thermal loading of the grate plates is reduced when restarting.

The invention leads to the grate covering being evened out and, as a result of the smaller fluctuation of the temperature of the secondary air passed into the kiln, to better utilization of the cooling air from the point of view of heat economy.

DETAILED DESCRIPTION OF A PREFERRED EMBODIMENT

It has been found that the height of the bed of material to be cooled is the most important influencing variable. It is therefore preferably put into effect to a greater extent than the flow resistance. In practice, this may be realized by the height of the bed of material to be cooled being used as reference variable and by the flow resistance being used as disturbance variable or correcting variable. In an especially advantageous embodiment, the instantaneous flow resistance is not used directly or not only directly, but rather its initial derivation or its deviation from the long-time value is used instead or in addition.

The flow resistance and/or its initial derivation is therefore applied as correcting variable to the set point, predetermined by the clinker bed height, of the conveying speed in order to compensate for the influence of the grain size on the heat transfer and to permit an approximately constant feedback of energy into the kiln and if need be to enable the heat exchange to be evened out. If the pressure resistance in the clinker drops, the set point of the clinker bed height is increased in a corrective manner in order to improve the heat exchange. If the pressure resistance in the bed of material to be cooled increases, the set point of the bed height is reduced in order to keep the heat exchange at a constant level.

However, it is also possible to use the flow resistance as reference variable and the layer height as correcting variable. Furthermore, in both cases, the change in the layer height per unit time may also be included in the control.

In the present context, the term control primarily means the influencing of the conveying speed in a closed control loop, in conformity with conventional terminology. However, influencing in an open loop, which is normally designated as open-loop control, is not thus to be ruled out.

Known radar instruments, for example, are suitable for measuring the height of the bed of material to be cooled in the initial region of the cooler. The flow resistance in the initial region of the cooler is obtained from the cooling-air volume used there, which is controlled at a constant level, and the differential pressure, resulting in the process, between the air supplied and the grate top space or (as a simplification) from the counterpressure.

The conveying speed in the present context refers to the speed of the grate motion. In the case of a sliding grate, this corresponds to the product of sliding length and frequency of the oscillating sliding motion. It may differ from the transport speed of the bed of material to be cooled located thereon.

EXAMPLE

The conveying speed of the sliding grate of a cooler for cement clinker is to be controlled in such a way that a layer height of 600 mm is obtained, provided a value of the flow resistance which has been predetermined as normal in accordance with this layer height, for example 60 mbar, is measured in the process. If a lower flow resistance, for example 50 mbar, is measured at this layer height, the controller changes the set point of the layer height to 650 mm.

We claim:

1. A method of improving the efficiency of a grate cooler by controlling the conveying speed of the grate cooler as a function of the state of the bed of material to be cooled in the initial region of the cooler comprising the steps of measuring the height of the bed of material to be cooled in the initial region of the cooler, measuring the flow resistance of material to be cooled in the initial region of the cooler, and controlling the conveying speed of the grate cooler as a function of both the height of the bed of material to be cooled and the flow resistance in the initial region of the cooler.

2. The method according to claim 1, wherein the height of the bed of material to be cooled is used as a primary reference variable and the flow resistance is used as a secondary correcting variable.

3. The method according to claim 1 including the steps of determining the change of the height and flow resistance per unit of time or their deviation from their long-time value and controlling the conveying speed as a function of both changes.

4. The method of claim 1 wherein the flow resistance is used as a primary reference variable and the height of the bed of material to be cooled is used as a secondary correcting variable.

* * * * *

UNITED STATES PATENT AND TRADEMARK OFFICE
Certificate

Patent No. 6,036,483 Patented: March 14, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Hartmut Meyer, Jurgen Cordes, Frank Wohlers, and Ulrich Cord.

Signed and Sealed this Fourteenth Day of August, 2001.

HENRY A. BENNETT
*SPE*
Art Unit 3744